US010786986B2

(12) United States Patent
Martin et al.

(10) Patent No.: US 10,786,986 B2
(45) Date of Patent: Sep. 29, 2020

(54) FLUID EJECTION ARRAY CONTROLLER

(71) Applicant: HEWLETT-PACKARD DEVELOPMENT COMPANY, L.P., Fort Collins, CO (US)

(72) Inventors: Eric Martin, Corvallis, OR (US); Chris Bakker, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/317,787

(22) PCT Filed: Oct. 14, 2016

(86) PCT No.: PCT/US2016/056938
§ 371 (c)(1),
(2) Date: Jan. 14, 2019

(87) PCT Pub. No.: WO2018/071034
PCT Pub. Date: Apr. 19, 2018

(65) Prior Publication Data

US 2019/0291421 A1 Sep. 26, 2019

(51) Int. Cl.
*B41J 2/045* (2006.01)

(52) U.S. Cl.
CPC ..... *B41J 2/04543* (2013.01); *B41J 2/0458* (2013.01); *B41J 2/04545* (2013.01)

(58) Field of Classification Search
CPC ... B41J 2/04543; B41J 2/04545; B41J 2/0458
See application file for complete search history.

(56) References Cited

U.S. PATENT DOCUMENTS

| | | | |
|---|---|---|---|
| 6,312,079 | B1 | 11/2001 | Anderson et al. |
| 6,318,828 | B1 | 11/2001 | Barbour et al. |
| 7,735,948 | B2 | 6/2010 | Walmsley et al. |
| 7,802,862 | B2 | 9/2010 | Walmsley et al. |
| 8,770,685 | B2 | 7/2014 | Shepherd et al. |
| 2006/0023012 | A1 | 2/2006 | Han |
| 2017/0190190 | A1* | 7/2017 | Yoshikawa ..... B41J 2/04543 |

FOREIGN PATENT DOCUMENTS

| | | |
|---|---|---|
| WO | WO-2010096059 A1 | 8/2010 |
| WO | WO-2009114012 | 9/2015 |
| WO | WO-2016068894 A1 | 5/2016 |

OTHER PUBLICATIONS

Rice, H.W. et al., Next-generation Inkjet Printhead Drive Electronics, Jun. 1997, < http://www.hpl.hp.com/hpjournal/97jun/jun97a5.pdf >.

* cited by examiner

*Primary Examiner* — Thinh H Nguyen
(74) *Attorney, Agent, or Firm* — Tong, Rea, Bentley & Kim, LLC

(57) ABSTRACT

An apparatus includes a plurality of nozzles configured to eject fluid and a fluid ejection array controller connected to the plurality of nozzles. The nozzles are arranged into a plurality of primitives, and the primitives are further arranged into a plurality of virtual primitives that each includes at least two primitives. The fluid ejection array controller generates ejection control data for each virtual primitive based on contents of a virtual primitive control packet. The ejection control data includes, for each virtual primitive, a first instruction instructing a first primitive of the virtual primitive to fire and a second instruction instructing a second primitive of the virtual primitive to not fire.

20 Claims, 7 Drawing Sheets

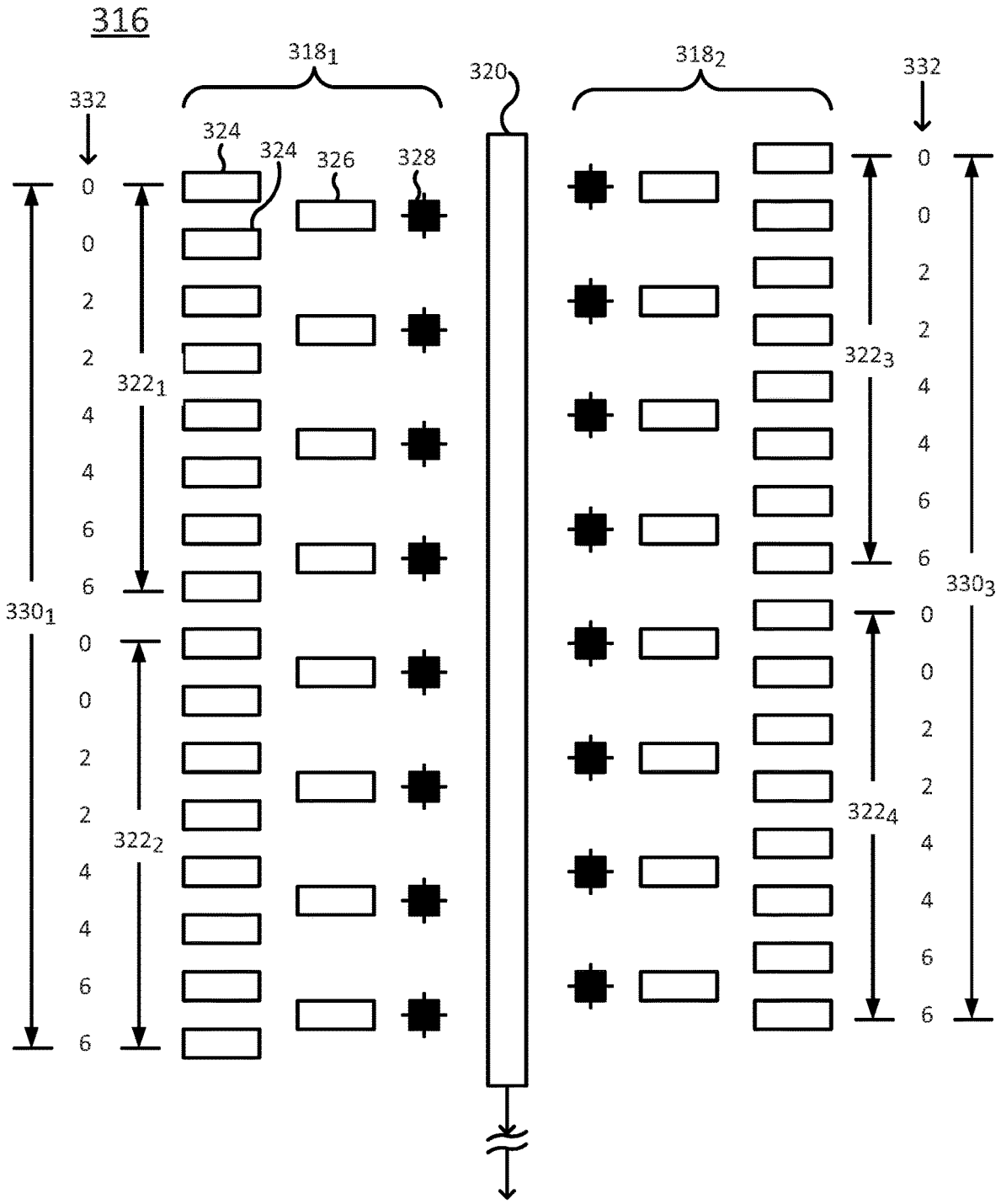
FIG. 3B A B
FIG. 3B-A

FLUID EJECTION ARRAY CONTROLLER

BACKGROUND

Many printing devices include one or more fluid ejection devices (e.g., print heads) designed to house cartridges filled with fluid (e.g., ink or toner in the case of an inkjet printing device, or a detailing agent in the case of a three dimensional printing device). The fluid ejection devices further include one or more nozzles via which the fluid is dispensed from the cartridges onto a substrate (e.g., paper). When printing a document, the print engine controller of the printing device may send commands to the fluid ejection devices that control when the individual nozzles of the fluid ejection devices "fire" or dispense fluid.

DETAILED DESCRIPTION

Figure 1:
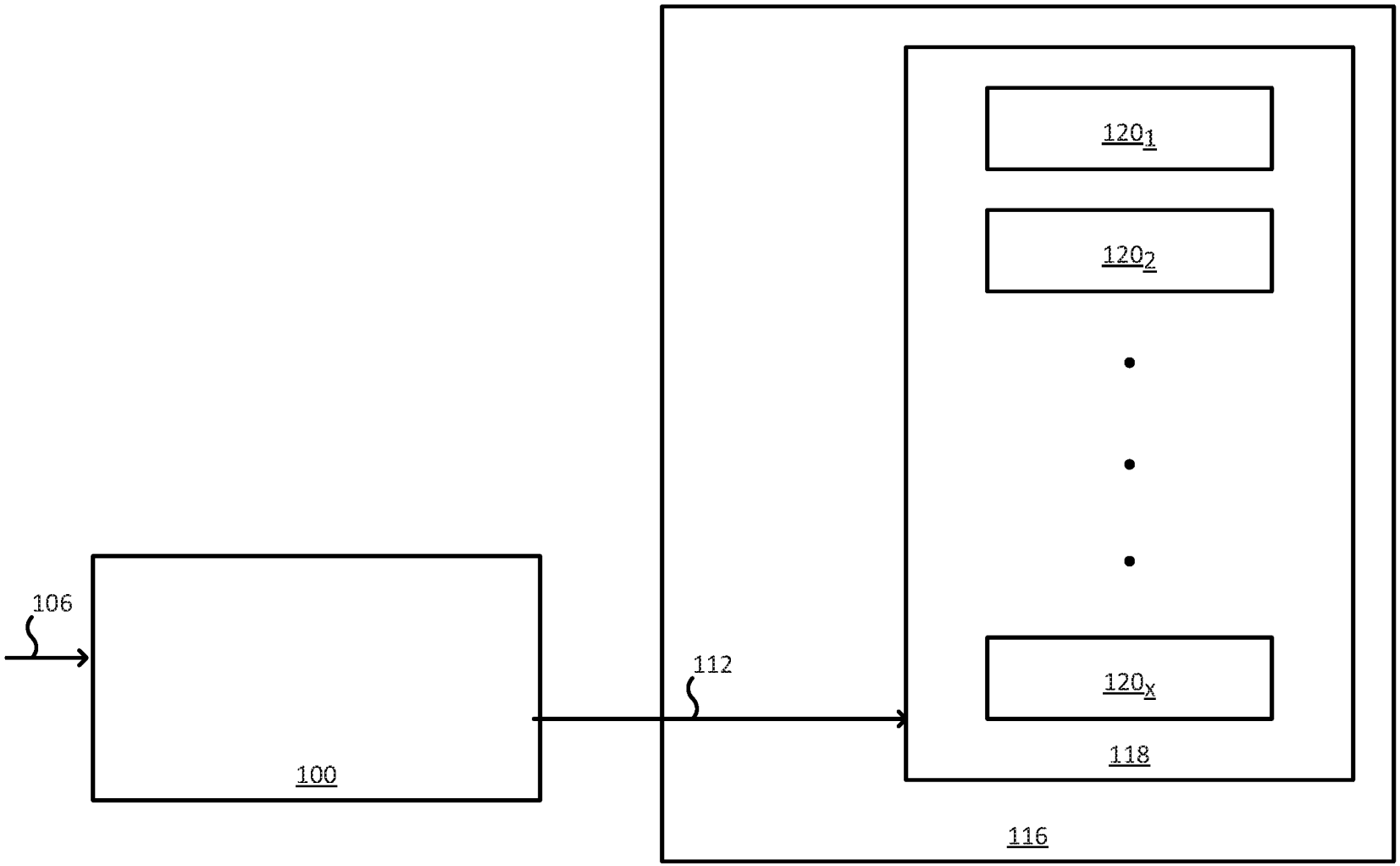
FIG. 1 illustrates an example of a fluid ejection array controller and a fluid ejection device of the present disclosure.

The present disclosure broadly describes an apparatus, method, and non-transitory computer-readable medium for configuring a data path between a print engine controller and a fluid ejection device of a printing device. When printing a document, the print engine controller of the printing device may send commands to the fluid ejection devices, via the data path, that control when the individual nozzles of the fluid ejection devices "fire" or dispense fluid (e.g., ink, toner in the case of an inkjet printing device or a detailing agent in the case of a three dimensional printing device).

For high-density print applications, the various nozzles may be grouped into a plurality of "primitives," such that one nozzle in each primitive fires at any given time based on the data loaded from the print engine controller (e.g., one bit of data per primitive). For lower density print applications, a plurality of primitives may be combined to form a "virtual" primitive in which one nozzle in each virtual primitive fires at any given time (thus, some primitives in the virtual primitive may not fire any nozzles). The data rate of and bandwidth consumed on the data path between the print engine controller and the fluid ejection devices is roughly the same for both applications (e.g., in this case, the data loaded for the non-firing primitives may be null), even though the lower density application fires a fraction of the number of nozzles of the higher density application at any given time. Moreover, the performance (e.g., print speed) of the fluid ejection devices is limited by the data rate of the data path between the print engine controller and the fluid ejection devices. Thus, transferring data at the high-density application rate may lower the performance of a low-density application, while also resulting in waste of data and bandwidth and higher hardware costs.

Examples of the present disclosure provide a flexible data protocol that can be used to load data from the print engine controller to the fluid ejection devices of a printing device for both high density and low density printing applications. In one example, the data packets used to convey commands from the print engine controller to the fluid ejection devices contain a dedicated bit that can be set in low density applications to indicate which primitive of a virtual primitive should be fired. From the setting of this bit, a local controller on the fluid ejection device can determine which primitive of the virtual primitive will not fire, and can at that point populate data to be loaded to that primitive with null data (e.g., zero bits). This minimizes the amount of data that is transmitted between the print engine controller and the fluid ejection device via the data path. For high density applications, the same data protocol may be used; however, the dedicated bit may not be set.

Although examples of the disclosure are discussed within the context of inkjet printing, the data protocols disclosed herein may be further applied to control the fluid ejection devices of three dimensional printing devices and other devices that eject fluid such as fluid (e.g., ink, toner, or the like) or detailing agents (e.g., binder materials, powders, or the like) used in additive manufacturing processes.

FIG. 1 illustrates an example of a fluid ejection array controller 100 and a fluid ejection device 116 of the present disclosure. In one example, the fluid ejection array controller 100 and the fluid ejection device 116 reside on a common die.

Figure 3A:
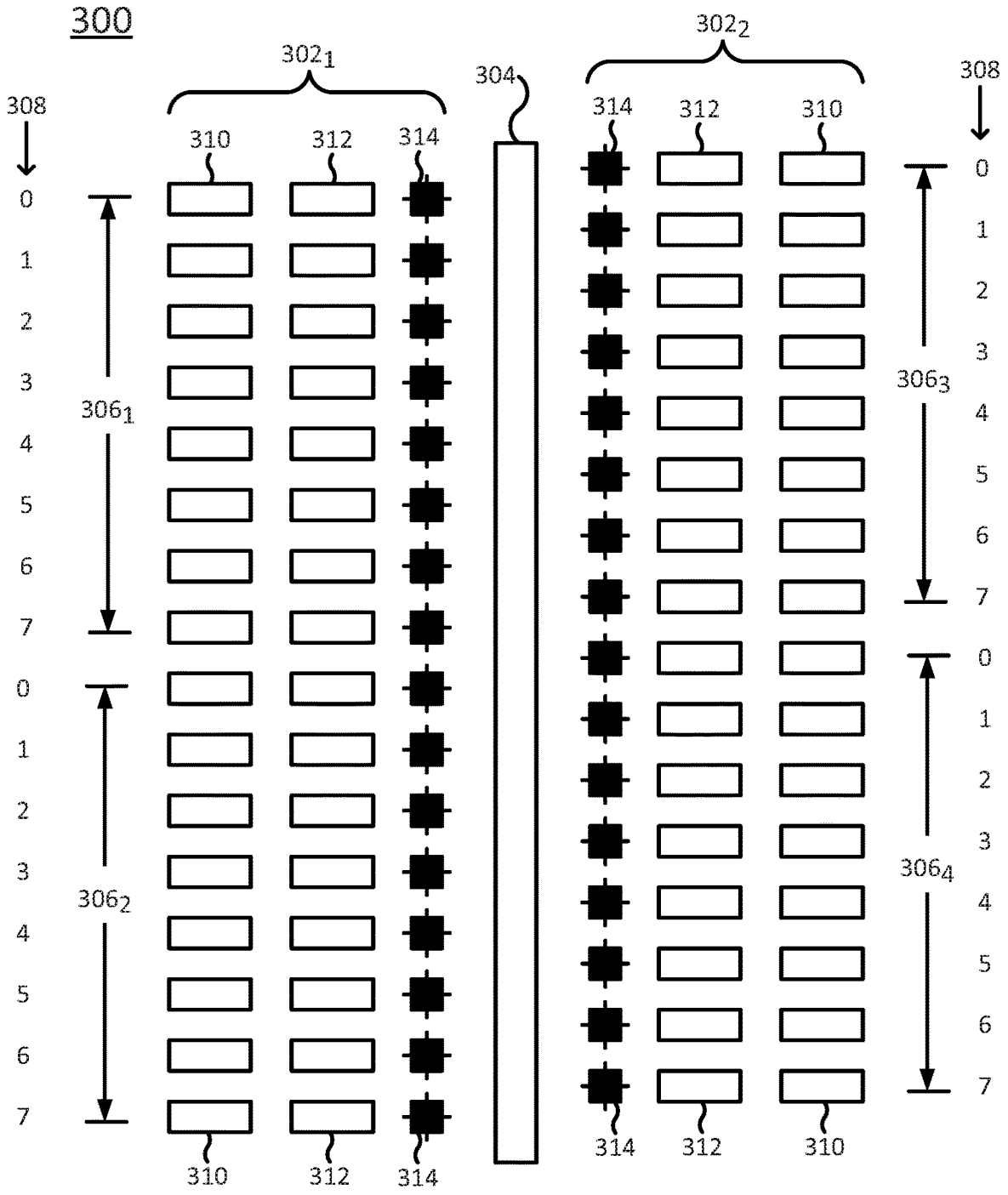
FIG. 3A illustrates a portion of a first example nozzle array such as may be implemented on the fluid ejection device of FIG. 2.
Figure 3B:
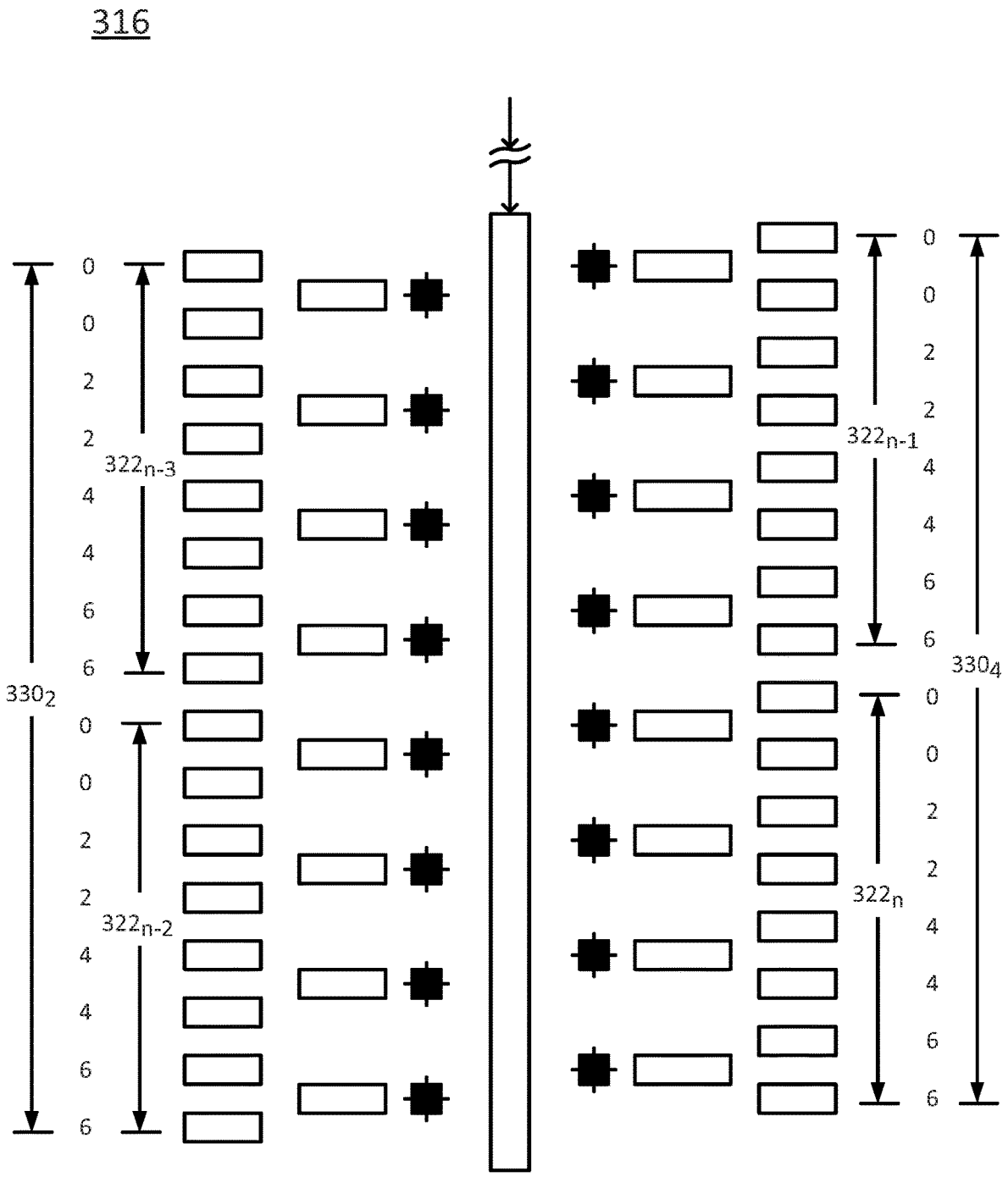
FIG. 3B illustrates a portion of a second example nozzle array such as may be implemented on the fluid ejection device of FIG. 2.

In one example, the fluid ejection device 116 is one of a plurality of fluid ejection devices (e.g., print heads) arranged in a fluid ejection array (e.g., a print bar) of a printing device (e.g., an inkjet printing device or a three dimensional printer). The fluid ejection device 116 generally comprises a nozzle array 118, which further comprises one or more nozzle columns $\mathbf{120}_1$-$\mathbf{120}_x$ (hereinafter collectively referred to as "nozzle columns 120") arranged in rows along the fluid ejection device 116. Each nozzle column 120 includes a plurality of nozzles arranged to dispense fluid onto a substrate, where the nozzles may be arranged into groups called "primitives." The primitives may be further arranged into groups called "virtual primitives." The number and arrangement of the nozzles may vary depending on the desired print density. FIGS. 3A and 3B, for instance, illustrate two example nozzle column arrangements that may be implemented on the fluid ejection device 116.

Figure 4:
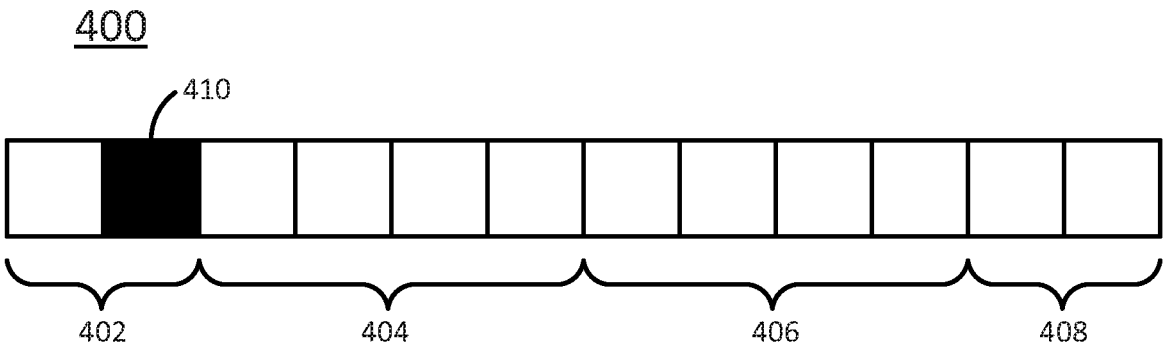
FIG. 4 illustrates one example of a virtual primitive control packet that may be used to communicate commands to fire nozzles of a fluid ejection device.

The fluid ejection array controller 100 is connected to the fluid ejection device 116 and receives virtual primitive control packets 106 for controlling ejection of fluid by the nozzles of the nozzle array 118. One example of a virtual primitive control packet is illustrated in FIG. 4. The virtual primitive control packets 106 are generated by a remote source such as a print engine controller of a printing system to which the fluid ejection array controller 100 and fluid ejection device 116 belong. A data path connects the remote source to the fluid ejection array controller 100 and transports the virtual primitive control packets 106 therebetween. The data path may be a high-speed data path, such as a multi-lane serial bus.

The fluid ejection array controller 100 generates ejection control data 112 for the nozzles of the nozzle array 118 (or, more specifically in some examples, for the virtual primitives of the nozzle array 118) based on the contents of the virtual primitive control packets 106. In the case where the primitives of the nozzle array 118 are further grouped into virtual primitives, the ejection control data 112 includes a first instruction instructing a first primitive of each virtual primitive to fire (i.e., eject fluid) and a second instruction instructing a second primitive of each virtual primitive to not fire.

Figure 2:
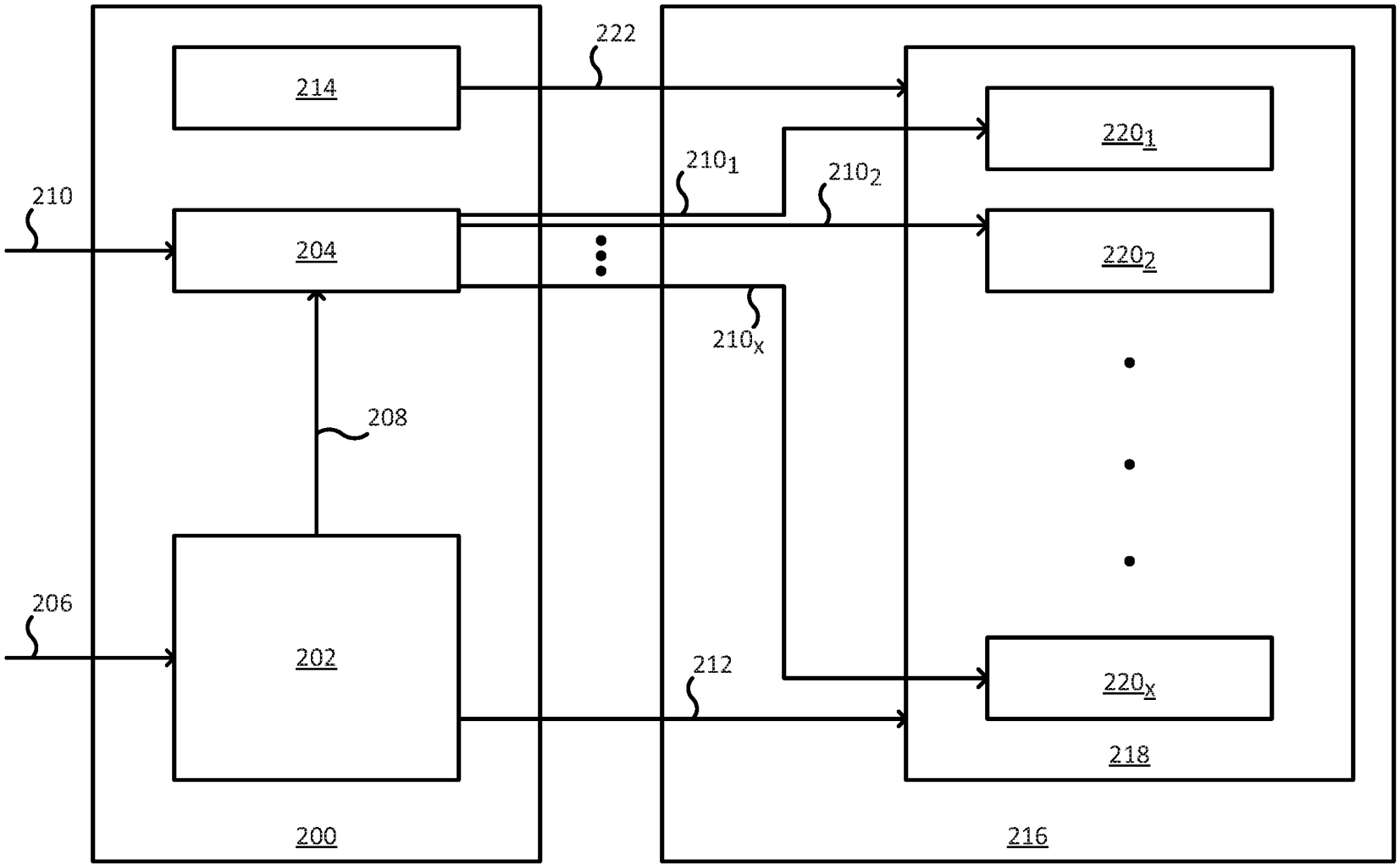
FIG. 2 illustrates a more detailed example of a fluid ejection array controller and a fluid ejection device of the present disclosure.

FIG. 2 illustrates a more detailed example of a fluid ejection array controller 200 and a fluid ejection device 216 of the present disclosure. As illustrated, the fluid ejection device 216 is substantially similar to the fluid ejection device 116 of FIG. 1. That is, the fluid ejection device 216 also comprises a nozzle array 218, which further comprises one or more nozzle columns $\mathbf{220}_1$-$\mathbf{220}_x$ (hereinafter collectively referred to as "nozzle columns 220") arranged in rows along the fluid ejection device 216. Each nozzle column 220 includes a plurality of nozzles arranged to dispense fluid onto a substrate, where the nozzles may be arranged into groups called "primitives." The primitives may be further arranged into groups called "virtual primitives." The number and arrangement of the nozzles may vary depending on the desired print density. FIGS. 3A and 3B, for instance, illustrate two example nozzle column arrangements that may be implemented on the fluid ejection device 116.

The fluid ejection array controller 200 is connected to the fluid ejection device 216 and generally comprises a packet receiver 202 and a print data generator 204 that work together to convert virtual primitive control packets 206 into ejection control data 212 that causes the appropriate nozzles on the fluid ejection device 216 to eject fluid. In one example, the fluid ejection array controller 200 may further comprise an address generator 214.

The packet receiver 202 receives virtual primitive control packets 206 (e.g., from the print engine controller. In one example, the virtual primitive control packets 206 are "fire pulse group" (or "FPG") packets containing data about which nozzles of the fluid ejection device 216 should fire. For instance, the virtual primitive control packets 206 may identify the primitives or virtual primitives containing the nozzles that are to fire, or the packets may contain bits of data for each primitive. One example of a fire pulse group is illustrated in further detail in FIG. 4.

Based on the information contained in the virtual primitive control packets 206, the packet receiver 202 writes unique primitive data (e.g., one nozzle's worth of data) to each primitive of the fluid ejection device 216. The unique primitive data is contained in the ejection control data 212. As discussed in further detail below, this may involve inserting the null values into the virtual primitive control packets 206 to indicate that a particular primitive should not fire any nozzles. The packet receiver 202 also deserializes the virtual primitive control packets 206 and forwards the deserialized data 208 to the print data generator 204.

The print data generator 204 generates a plurality of "fire" signals $\mathbf{210}_1$-$\mathbf{210}_x$ (hereinafter collectively referred to as "fire signals 210") based on the information in the deserialized data 208. A fire signal 210 instructs an addressed nozzle to fire. In one example, the print data generator 204 generates one fire signal 210 for each primitive on the fluid ejection device 216. In one example, the print data generator 204 populates the fire signals 210 with bit values (e.g., "0" or "1") that indicate whether a nozzle identified by a corresponding address should fire or not. The appropriate bit values for each address may be determined based on the setting of a dedicated bit in the virtual primitive control packets 206.

The address generator 214 conveys address data 222 to the primitives of the fluid ejection device 216. In one example, the address data 222 identifies (e.g., by corresponding address) which nozzles within the primitives of the fluid ejection device 216 should be fired. In one example, the address generator 214 is part of the fluid ejection array controller 200, but in other examples, the address generator 214 may be part of a remote device such as a remote print engine controller.

FIG. 3A illustrates a portion of a first example nozzle array 300 such as may be implemented on the fluid ejection device 216 of FIG. 2. In particular, FIG. 3A illustrates the top two primitives $\mathbf{306}_1$ and $\mathbf{306}_2$ or $\mathbf{306}_3$ and $\mathbf{306}_4$ (hereinafter collectively referred to as "primitives 306"), respectively, of two adjacent nozzle columns $\mathbf{302}_1$ and $\mathbf{302}_2$ (hereinafter collectively referred to as "nozzle columns 302") of the nozzle array 300. The complete nozzle array 300 may comprise additional, similarly configured primitives 306 arranged along the illustrated nozzle columns 302 (e.g., below the illustrated primitives 306), as well as additional, similarly configured nozzle columns arranged along the array 300 (e.g., adjacent to the illustrated columns 302).

In one example, the nozzle columns 302 illustrated in FIG. 3A are part of a relatively high-density nozzle array configuration. In this configuration, the two nozzle columns 302 are arranged on opposite sides of a fluid feed slot 304. The nozzles in each of the nozzle columns 302 dispense fluid into the fluid feed slot 304 when fired.

Each primitive 306 includes a plurality of nozzles 314 arranged along the fluid feed slot 304. For ease of illustration, one nozzle 314 is labeled in each of the primitives 306. In one example, each nozzle 314 is directly physically coupled to a heating resistor 312, which is, in turn, directly physically coupled to a firing field effect transistor (FET) 310. Each firing FET 310 is further logically coupled to a unique address (e.g., 0 through 7) within its respective primitive 306. Thus, in the example illustrated in FIG. 3A, there is a one-to-one correspondence between nozzles 314, heating resistors 312, firing FETs 310, and unique addresses within a primitive 306.

Referring simultaneously to FIGS. 2 and 3A, to fire the nozzles 314, unique primitive data (e.g., one nozzle's worth of data) is written to each primitive 306 in the ejection control data 212, e.g., by the packet receiver 202 of the fluid ejection array controller 200. The unique primitive data may include one or more bits containing a non-null value (e.g., "1") to indicate that a corresponding primitive should fire, or a null value (e.g., "0") to indicate that the corresponding primitive should not fire. In one example, the null values are inserted by the packet receiver 202 into a virtual primitive control packet 206.

Additionally, address data 222 may be conveyed to each primitive 306 (e.g., in a separate signal from the address generator 214 of the fluid ejection array controller 200 or in the same data packet conveying the ejection control data 212). In one example, all primitives within a primitive group (e.g., nozzle column 302) use the same address data. For instance, if the address data 222 indicates that the nozzle 314 at address "2" should be fired, then each primitive 306 in the corresponding nozzle column 302 will fire its respective nozzle 314 corresponding to the "2" address. Thus, the address supplied to a primitive 306 selects which nozzle 314 within the primitive 306 fires the unique primitive data, ultimately resulting in fluid being dispensed into the fluid feed slot 304.

Each primitive 306 is also supplied with a "fire" signal 210, e.g., by the print data generator 204. A given nozzle 314 within a primitive 306 will thus fire (e.g., dispense fluid) when: (1) the unique primitive data loaded into that primitive 306 (via the ejection control data 212) indicates that firing should occur within the primitive 306; (2) the address data 222 conveyed to the primitive 306 matches the address of the nozzle 314 in the primitive 306; and (3) a fire signal 210 is received by the primitive 306.

FIG. 3B illustrates a portion of a second example nozzle array 316 such as may be implemented on the fluid ejection device 216 of FIG. 2. In particular, FIG. 3B illustrates the top two primitives and bottom two primitives $\mathbf{322}_1$-$\mathbf{322}_n$ (hereinafter collectively referred to as "primitives 322") of two adjacent nozzle columns $\mathbf{318}_1$ and $\mathbf{318}_2$ (hereinafter collectively referred to as "nozzle columns 318") of the nozzle array 316. The complete nozzle array 316 may comprise additional, similarly configured primitives 322 arranged along the illustrated columns 318 (e.g., between the illustrated primitives 318), as well as additional, similarly configured nozzle columns arranged along the array 316 (e.g., adjacent to the illustrated columns 318).

In one example, the nozzle columns 318 illustrated in FIG. 3B are part of a relatively low-density nozzle array configuration (e.g., relative to the nozzle array configuration illustrated in FIG. 3A). In this configuration, the two nozzle columns 318 are arranged on opposite sides of a fluid feed slot 320. The nozzles in each of the nozzle columns 318 dispense fluid into the fluid feed slot 320 when fired.

Each primitive 322 includes a plurality of nozzles 328 arranged along the fluid feed slot 320. For ease of illustration, one nozzle 328 is labeled in the primitives $\mathbf{322}_1$. In one example, each nozzle 328 is directly physically coupled to a heating resistor 326, which is, in turn, directly physically coupled to a plurality of (e.g., at least two) firing field effect transistor (FET) 324. Each firing FET 324 is further logically coupled to an address 332 (e.g., 0 through 6, skipping odd numbers) within its respective primitive 322 that is shared with at least one other firing FET 324. Thus, in the example illustrated in FIG. 3B, there is a one-to-one correspondence between nozzles 328 and heating resistors 326, but a two-to-one correspondence between nozzles 328 and firing FETs 324 and between firing FETs 324 and unique addresses 332 within a primitive 322.

Furthermore, in the example illustrated in FIG. 3B, the primitives 322 are further grouped into "virtual primitives" $\mathbf{330}_1$-$\mathbf{330}_n$ (hereinafter collectively referred to as "virtual primitives 330"), where each virtual primitive 330 includes a plurality of (i.e., at least two) of the primitives 322. For example, the combination of primitives $\mathbf{322}_1$ and $\mathbf{322}_2$ forms the virtual primitive $\mathbf{330}_1$.

Referring simultaneously to FIGS. 2 and 3B, to fire the nozzles 328, unique primitive data (e.g., two nozzle's worth of data) is written to each virtual primitive 330 in the ejection control data 212, e.g., by the print data generator 204 of the fluid ejection array controller 200. The unique primitive data may include one or more bits containing a non-null value (e.g., "1") to indicate that one primitive 322 of the virtual primitive 330 should fire, and one or more bits containing a null value (e.g., "0") to indicate that another primitive 322 of the virtual primitive 330 should not fire. In one example, the null values are inserted by the packet receiver 202 into a virtual primitive control packet 206.

Additionally, address data 222 is conveyed to each virtual primitive 330 (e.g., in a separate signal from the address generator 214 or in the same data packet conveying the ejection control data 212). In one example, all virtual primitives 330 within a primitive group (e.g., nozzle column 318) use the same address data. For instance, if the address data 222 indicates that the nozzle 328 at address "0" should be fired, then each virtual primitive 330 in the corresponding nozzle column 318 will fire its respective nozzle 328 corresponding to the "0" address. In this case, firing of the corresponding nozzle 328 will involve a plurality of (e.g., two in the case of FIG. 3B) firing FETs 324 supplying energy to a corresponding resistor 326. Thus, the address supplied to a virtual primitive 330 selects which nozzle 328 within the virtual primitive 330 fires the unique primitive data, ultimately resulting in fluid being dispensed into the fluid feed slot 320.

In one example, one nozzle 328 per virtual primitive 330 may be fired at a given time (as opposed to one nozzle per primitive, as in FIG. 3A). However, in order to fire the one nozzle 328, multiple bits of data may be loaded from the print engine controller, i.e., one bit for each primitive 322 in the virtual primitive 330. For instance, to fire a nozzle 328 within the virtual primitive $\mathbf{330}_1$, one bit may be loaded for the primitive $\mathbf{322}_1$ and one bit may be loaded for the primitive $\mathbf{322}_2$, even though one of those bits will be a "0." Extending this to a nozzle column 318, in every set of ejection control data 212, at least one primitive in each virtual primitive would be loaded with a "0" bit.

Each primitive 306 is also supplied with a "fire" signal 210, e.g., by the print data generator 204. A given nozzle 314 within a primitive 306 will thus fire (dispense fluid) when: (1) the unique primitive data loaded into that primitive 306 (via the ejection control data 212) indicates that firing should occur within the primitive 306; (2) the address data 222 conveyed to the primitive 306 matches the address of the nozzle 314 in the primitive 306; and (3) a fire signal 210 is received by the primitive 306.

The die of the fluid ejection device 216 may be designed to include firing FETs of the number and density shown in FIG. 3A, in FIG. 3B, or other numbers and densities. Additional circuitry and fluidic layers (which may include the layers to build resistors and interconnect layers to configure nozzle addressing) may be fabricated on top of the fluid ejection device die. These additional layers can be configured to produce one resistor, nozzle, and unique address per firing FET per primitive (as illustrated in FIG. 3A) or one resistor, nozzle, and unique address per pair of firing FETs per virtual primitive (as illustrated in FIG. 3B). This allows a single circuit design to be coupled with multiple fluidic designs to serve a range of applications at relatively low cost.

FIG. 4 illustrates one example of a virtual primitive control packet 400 that may be used to communicate commands to fire nozzles of a fluid ejection device. In one example, the virtual primitive control packet 400 is a fire pulse group (or FPG) packet. As discussed above, the virtual primitive control packet 400 may be used to communicate data from the print engine controller to the fluid ejection array controller 100 of FIG. 1 or the fluid ejection array controller 200 of FIG. 2. Thus, for sake of example, reference may be made in the discussion of the virtual primitive control packet 400 to various elements of FIG. 2, although such reference is not intended to be limiting.

In one example, the virtual primitive control packet 400 generally includes a header 402, a payload comprising a set of address bits 404 and/or a set of fire data bits 406, and a footer 408. The example illustrated in FIG. 4 is an abstraction and is not meant to limit the number of bits that may be included in the packet 400 or in any particular portion of the packet 400.

In one example, the header 402 comprises one or more bits that are used by the packet receiver 202 of the fluid ejection array controller 200 to detect the start of the virtual primitive control packet 400. Thus, the header 402 may include some predefined sequence of bits that indicates the start of aa virtual primitive control packet. Additionally, the header 402 may include a sequence of bits that controls the data path between the print engine controller and the fluid ejection array controller 200.

In one example, the header 402 additionally includes one or more primitive select bits 410. The primitive select bits 410 may be used, for example, to identify which primitive within a virtual primitive is being addressed (and should, consequently, fire). Thus, the primitive select bits 410 may be employed when the virtual primitive control packet 400 is being sent to a fluid ejection array controller 200 of a fluid ejection device that is configured with a low-density nozzle configuration such as that illustrated in FIG. 3B. The primitive select bits 410 may be set rather than setting null address bits for each primitive in a virtual primitive that is not to fire. Thus, this reduces the amount of data that is transmitted in the virtual primitive control packet 400. In one example, the primitive select bits 410 may be contained in a different portion of the virtual primitive control packet 400, such as the payload or the footer 408.

In one example, the set of address bits 404 identifies, for each primitive, an address (also referred to as an "embedded address") corresponding to a nozzle to be fired (i.e., to fire the unique primitive data and eject fluid). In one example, the set of address bits 404 may be omitted from the virtual primitive control packet 400; in this case, the address data 222 may be generated by the address generator 214 of the fluid ejection array controller 200.

In one example, the set of fire data bits 406 includes one nozzle's worth of data (e.g., unique primitive data) for each primitive on the fluid ejection device 216. The data included in the set of fire data bits 406 determines whether the nozzle that is identified by the set of address bits within a particular primitive should fire. For instance, the fire data bits may include a non-null value (e.g. "1") to indicate that a nozzle of a primitive should fire. The data included in the set of fire data bits 406 may be different for each primitive.

In one example, the footer 408 comprises one or more bits that are used by the packet receiver 202 of the fluid ejection array controller 200 to detect the end of the virtual primitive control packet 400. Thus, the footer 408 may include some predefined sequence of bits that indicates the end of an virtual primitive control packet.

Once the virtual primitive control packet 400 is loaded to the fluid ejection array controller 200, the print data generator 204 of the fluid ejection array controller 200 will generate the fire signals 210. The fire signals 210 are then sent to the primitive groups on the fluid ejection device 216, and the primitive groups will fire the nozzles addressed by the fire signals 210. To fire all of the nozzles on the fluid ejection device 216 at once, a virtual primitive control packet 400 would thus be loaded for every address value.

Figure 5:
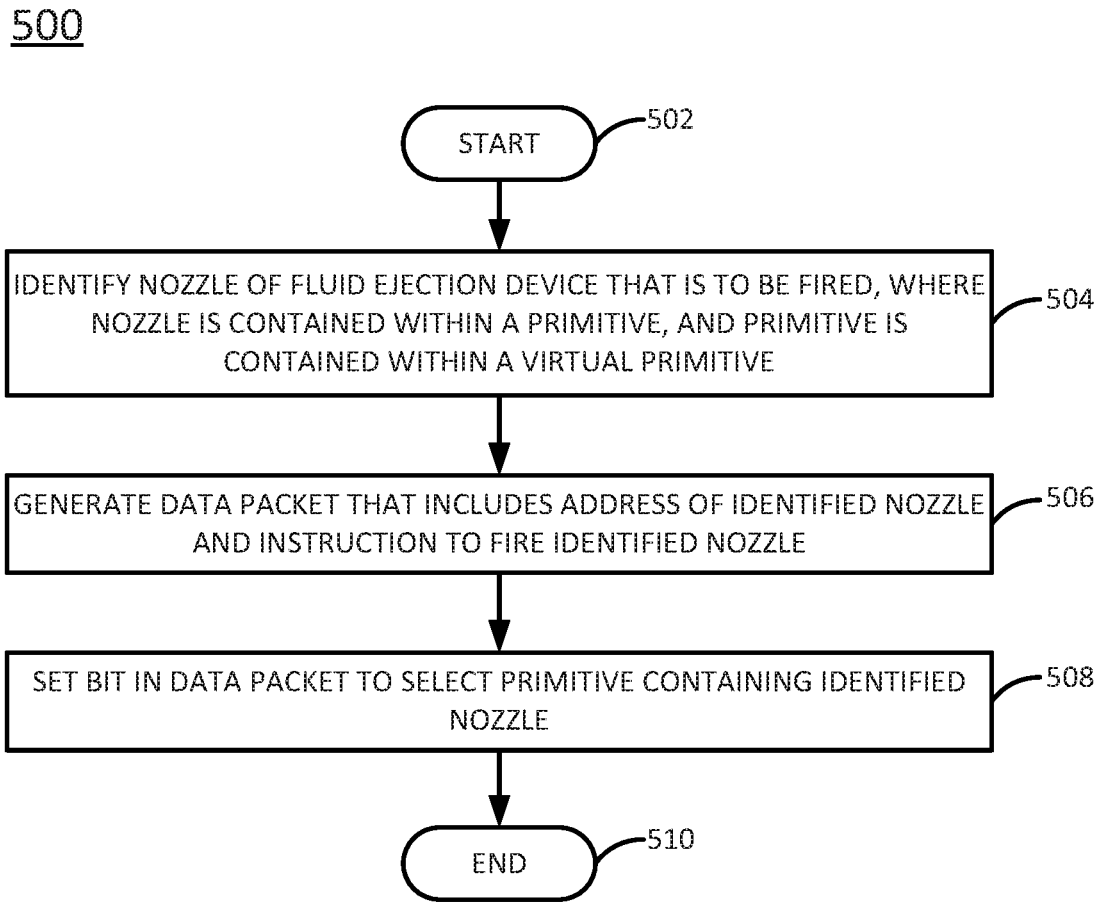
FIG. 5 illustrates a flowchart of a first example method for controlling a fluid ejection device, according to the present disclosure.

FIG. 5 illustrates a flowchart of a first example method 500 for controlling a fluid ejection device, according to the present disclosure. The method 500 may be performed, for example, by a print engine controller of a printing system that is connected, via a data path, to a fluid ejection array controller.

The method 500 begins in block 502. In block 504, the print engine controller identifies a nozzle of a fluid ejection device that is to be fired to produce a print output. In one example, the fluid ejection device is configured in a manner similar to the configuration illustrated in FIG. 3B. That is, the nozzles of the fluid ejection device are grouped into a plurality of multiple nozzle groups or primitives, and the primitives are further grouped into a plurality of multiple primitive groups or virtual primitives. Within each primitive of a virtual primitive, two firing FETs sharing a common address supply energy to a single resistor, which, when energized, induces a corresponding nozzle to fire.

In block 506, the print engine controller generates a data packet that includes an address of the nozzle identified in block 504 as well as an instruction (e.g., a non-null value in a fire data bit) instructing the fluid ejection device to fire the identified nozzle. The data packet may be configured in a manner similar to the virtual primitive control packet 400 illustrated in FIG. 4.

In block 508, the print engine controller sets a bit in the data packet that selects the group of nozzles containing the identified nozzle. For example, the print engine controller may set the primitive select bit(s) 410 of the FPG packet 400 to select the primitive that contains the identified nozzle from among two or more primitives included in a given virtual primitive.

The print engine controller may then send the data packet (e.g., to the fluid ejection array controller of the fluid ejection device) before the method 500 ends in block 510.

Figure 6:
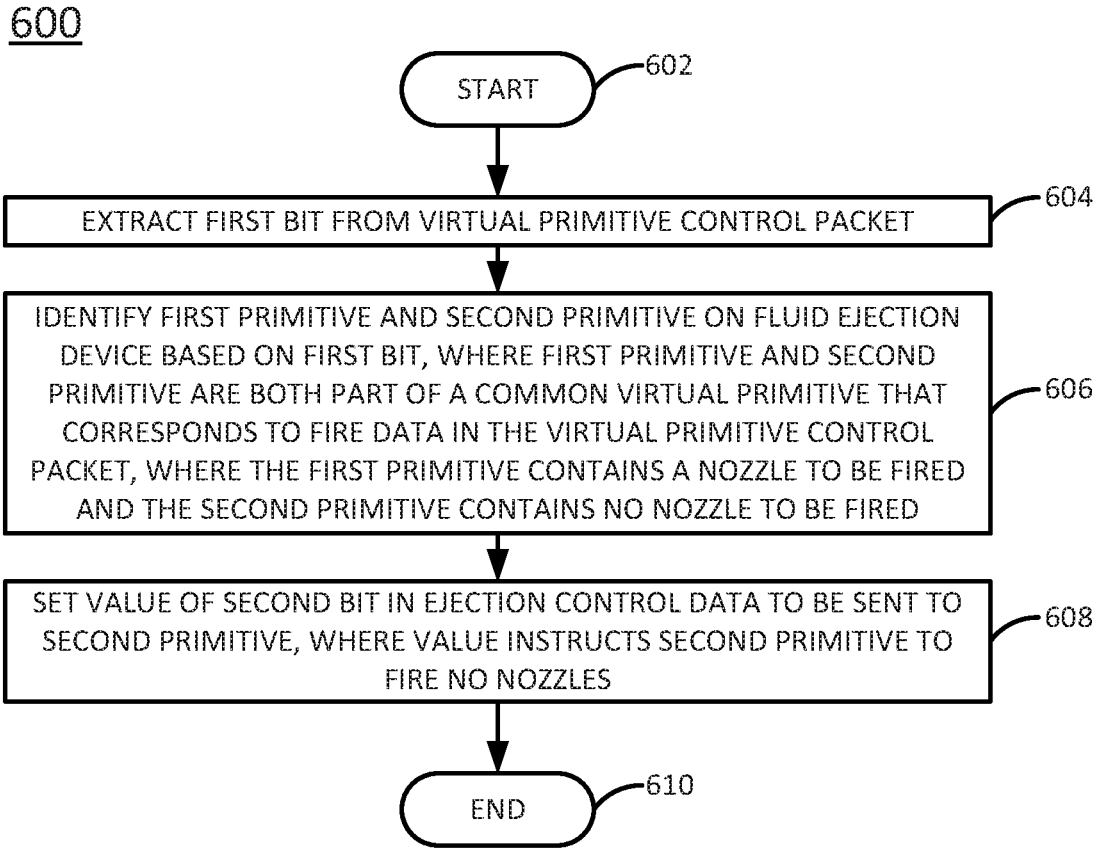
FIG. 6 illustrates a flowchart of a second example method for controlling a fluid ejection device, according to the present disclosure.

FIG. 6 illustrates a flowchart of a second example method 600 for controlling a fluid ejection device, according to the present disclosure. The method 600 may be performed, for example, by a fluid ejection array controller of a fluid ejection device, such as the fluid ejection array controller 100 illustrated in FIG. 1 or the fluid ejection array controller 200 illustrated in FIG. 2. As such, reference is made in the discussion of FIG. 6 to various components of FIG. 2 to facilitate understanding. However, the method 600 is not limited to implementation with the systems illustrated in FIGS. 1 and 2.

The method 600 begins in block 602. In block 604, the fluid ejection array controller 200 (e.g., via the packet receiver 202 of the fluid ejection array controller 200) extracts a first bit from a virtual primitive control packet 206. In one example, the data packet is a virtual primitive control packet such as the virtual primitive control packet 400 illustrated in FIG. 4.

In block 606, the fluid ejection array controller 200 (e.g., via the packet receiver 202) identifies a first group of nozzles on the fluid ejection device 216 that is selected by the first bit extracted from the virtual primitive control packet. Thus, the first bit may be the primitive select bit 410 described in connection with the virtual primitive control packet 400 of FIG. 4. The group of nozzles that is selected by the primitive select bit may be a primitive that is one of a plurality of primitives that is further grouped into a common virtual primitive. In one example, the virtual primitive includes at least a first primitive containing a nozzle that is to be fired and a second primitive containing no nozzles to be fired.

In block 608, the fluid ejection array controller 200 (e.g., via the packet receiver 202) sets a value of a second bit in unique primitive data to be sent to the primitives of the fluid ejection device 216 (e.g., in ejection control data 212). The second bit instructs a primitive that contains no nozzles to be fired to not fire any nozzles. In one example, the value of the second bit may be a null value (e.g., "0"). The unique primitive data may already contain a value for a third bit, set by the print engine controller for instance, that instructs a primitive that contains the nozzle to be fired to fire the nozzle. In one example, the value of the third bit may be a non-null value (e.g., "1").

The fluid ejection array controller 200 may send the unique primitive data (e.g., via the packet receiver 202) to the primitives of the fluid ejection device 216 before the method 600 ends in block 610.

Thus, to fire an entire nozzle column (e.g., fire every nozzle in the nozzle column) of the high-density fluid ejection device 300 illustrated in FIG. 3A, the print engine controller would send a virtual primitive control packet 206 for each address (e.g., 0, 1, 2, 3, 4, 5, 6, 7) to the fluid ejection array controller 200. The fluid ejection array controller 200 would, based on the data in the virtual primitive control packet 206, load one bit for each primitive 306 in the nozzle column 302. The fluid ejection array controller 200 would further generate a fire signal 210 that results in all of the nozzles 314 in the nozzle column 302 being fired.

However, to fire an entire nozzle column (e.g., fire every nozzle in the nozzle column) of the low-density fluid ejection device 316 illustrated in FIG. 3B, the process is different. In this case, the nozzles 328 are fired in at least two series of steps (e.g., one series of steps for each primitive included in a virtual primitive).

First, the print engine controller sets the primitive select bit of a first virtual primitive control packet 206 for each address (e.g., 0, 2, 4, 6). The primitive select bit selects a first primitive 322 within each virtual primitive 330. For instance, the "top" primitive of each virtual primitive 330 may be selected.

When the fluid ejection array controller 200 receives the first virtual primitive control packet 206 for each address, the packet receiver 202 of the fluid ejection array controller 200 will automatically populate the unique primitive data in the ejection control data 212 that is sent to the nozzle columns with null data that will cause the unselected primitive(s) 322 of each virtual primitive 330 to be loaded with the null data (e.g., a "0" bit). The print data generator 204 of the fluid ejection array controller 200 will then generate a fire signal 210, and the nozzles at each of the addresses within the selected first primitive will fire.

Next, the print engine controller sets the primitive select bit of a second virtual primitive control packet 206 for each address (e.g., 0, 2, 4, 6). The primitive select bit selects a second primitive 322, different from the first primitive, within each virtual primitive 330. For instance, the "bottom" primitive of each virtual primitive 330 may be selected if the "top" primitive was selected as the first primitive.

When the fluid ejection array controller 200 receives the second virtual primitive control packet 206 for each address, the packet receiver 202 of the fluid ejection array controller 200 will automatically populate the unique primitive data in the ejection control data 212 that is sent to the nozzle columns with null data that will cause the unselected primitive(s) 322 of each virtual primitive 330 to be loaded with the null data (e.g., a "0" bit). The print data generator 104 of the fluid ejection array controller 100 will then generate a fire signal 210, and the nozzles at each of the addresses within the selected second primitive will fire.

Thus, each virtual primitive control packet 400 in the low-density configuration example is loading a fraction (e.g., half) of the number of fire data bits 406. That is, in this example, values are not set by the print engine controller for the fire data bits 406 corresponding to the unselected primitive of a virtual primitive. Instead, these values are automatically populated with null data (e.g., "0") by the fluid ejection array controller 200 (e.g., via the packet receiver 202) upon receipt of the virtual primitive control packet 400 and extraction of the primitive select bit 410. This reduces the data rate of the data path between the print engine controller and the fluid ejection array controller 200. Thus, total system cost can be reduced by reducing the data rate of the existing physical data channels or by reducing the number of physical data channels (but keeping the data rates of the remaining physical data channels the same).

It should be noted that although not explicitly specified, some of the blocks, functions, or operations of the methods 500 and 600 described above may include storing, displaying and/or outputting for a particular application. In other words, any data, records, fields, and/or intermediate results discussed in the methods can be stored, displayed, and/or outputted to another device depending on the particular application. Furthermore, blocks, functions, or operations in FIGS. 5 and 6 that recite a determining operation, or involve a decision, do not necessarily imply that both branches of the determining operation are practiced. In other words, one of the branches of the determining operation can be deemed to be optional.

Figure 7:
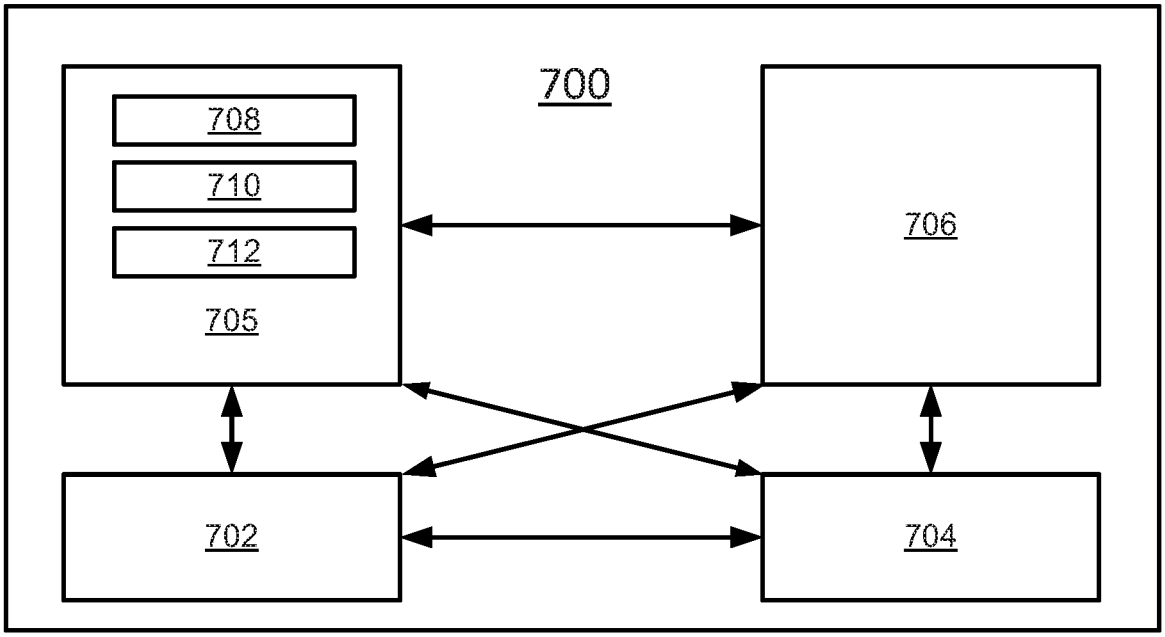
FIG. 7 depicts a high-level block diagram of an example computer that can be transformed into a machine capable of performing the functions described herein.

FIG. 7 depicts a high-level block diagram of an example computer 700 that can be transformed into a machine capable of performing the functions described herein. Examples of the present disclosure modify the operation and functioning of the general-purpose computer to control a fluid ejection device, as disclosed herein. The computer 700 may be configured as a print engine controller or a fluid ejection array controller of a printing system, such as the print engine controller 114 and the fluid ejection array controller 138 illustrated in FIGS. 1 and/or 2.

As depicted in FIG. 7, the computer 700 comprises a hardware processor element 702, e.g., a central processing unit (CPU), a microprocessor, or a multi-core processor, a memory 704, e.g., random access memory (RAM) and/or read only memory (ROM), a module 705 for controlling a fluid ejection device, and various input/output devices 706, e.g., storage devices, including but not limited to, a tape drive, a floppy drive, a hard disk drive or a compact disk drive, a receiver, a transmitter, a speaker, a display, a speech synthesizer, an output port, an input port and a user input device, such as a keyboard, a keypad, a mouse, a microphone, and the like. Although one processor element is shown, it should be noted that the general-purpose computer may employ a plurality of processor elements. Furthermore, although one general-purpose computer is shown in the figure, if the method(s) as discussed above is implemented in a distributed or parallel manner for a particular illustrative example, i.e., the blocks of the above method(s) or the entire method(s) are implemented across multiple or parallel general-purpose computers, then the general-purpose computer of this figure is intended to represent each of those multiple general-purpose computers. Furthermore, a hardware processor can be utilized in supporting a virtualized or shared computing environment. The virtualized computing environment may support a virtual machine representing computers, servers, or other computing devices. In such virtualized virtual machines, hardware components such as hardware processors and computer-readable storage devices may be virtualized or logically represented.

It should be noted that the present disclosure can be implemented by machine readable instructions and/or in a combination of machine readable instructions and hardware, e.g., using application specific integrated circuits (ASIC), a programmable logic array (PLA), including a field-programmable gate array (FPGA), or a state machine deployed on a hardware device, a general purpose computer or any other hardware equivalents, e.g., computer readable instructions pertaining to the method(s) discussed above can be used to configure a hardware processor to perform the blocks, functions and/or operations of the above disclosed methods.

In one example, instructions and data for the present module or process 705 for controlling a fluid ejection device, e.g., machine readable instructions can be loaded into memory 704 and executed by hardware processor element 702 to implement the blocks, functions or operations as discussed above in connection with the methods 500 and 600. For instance, the module 705 may include a plurality of programming code components, including a packet generation component 708, a bit set component 710, and a bit extraction component 712.

The packet generation component 708 may be configured to generate a fire pulse group packet such as the FPG packet 400 illustrated in FIG. 4. For instance, the packet generation component 708 may be configured to perform block 506 of the method 500 described above.

The bit set component 710 may be configured to set a bit in a fire pulse group packet (e.g., a primitive select bit) or to set a bit in primitive data sent to a nozzle column of a fluid ejection device. For instance, the bit set component 710 may be configured to perform block 508 of the method 500 or block 608 of the method 600 described above.

The bit extraction component 712 may be configured to extract a bit from a fire pulse group packet that can be used to identify a selected primitive on a fluid ejection device. For instance, the bit extraction component 712 may be configured to perform blocks 604 and/or 606 of the method 600 described above.

Furthermore, when a hardware processor executes instructions to perform "operations", this could include the hardware processor performing the operations directly and/or facilitating, directing, or cooperating with another hardware device or component, e.g., a co-processor and the like, to perform the operations.

The processor executing the machine readable instructions relating to the above described method(s) can be perceived as a programmed processor or a specialized processor. As such, the present module 705 for controlling a fluid ejection device, including associated data structures, of the present disclosure can be stored on a tangible or physical (broadly non-transitory) computer-readable storage device or medium, e.g., volatile memory, non-volatile memory, ROM memory, RAM memory, magnetic or optical drive, device or diskette and the like. More specifically, the computer-readable storage device may comprise any physical devices that provide the ability to store information such as data and/or instructions to be accessed by a processor or a computing device such as a computer or an application server.

It will be appreciated that variants of the above-disclosed and other features and functions, or alternatives thereof, may be combined into many other different systems or applications. Various presently unforeseen or unanticipated alternatives, modifications, or variations therein may be subsequently made which are also intended to be encompassed by the following claims.

What is claimed is:

1. An apparatus, comprising:

a plurality of nozzles to eject fluid, the plurality of nozzles being arranged into a plurality of primitives, and the plurality of primitives being further arranged into a plurality of virtual primitives that each includes at least two primitives of the plurality of primitives; and a fluid ejection array controller connected to the plurality of nozzles, the fluid ejection array controller to generate ejection control data for each virtual primitive of the plurality of virtual primitives based on contents of a virtual primitive control packet, wherein the ejection control data includes a first instruction instructing a first primitive of the each virtual primitive to fire and a second instruction instructing a second primitive of the each virtual primitive to not fire.

2. The apparatus of claim 1, wherein the fluid ejection array controller comprises:

an interface to a data path over which the virtual primitive control packet travels;

a packet receiver to extract a first bit from the virtual primitive control packet and to populate bits of data in the second instruction with values that indicate that nozzles of the second primitive of the each virtual primitive should not fire; and a print data generator to generate a signal instructing each virtual primitive of the plurality of virtual primitives to fire.

3. The apparatus of claim 2, wherein the first bit is contained within a header of the virtual primitive control packet.

4. The apparatus of claim 2, wherein the values are null values.

5. The apparatus of claim 1, wherein the apparatus is an inkjet printing device, and the fluid ejection array controller is included in a print engine of the inkjet printing device.

6. The apparatus of claim 1, wherein the plurality of nozzles and the print engine controller reside on a common die.

7. The apparatus of claim 1, wherein within each primitive of the plurality of primitives, each nozzle of the plurality of nozzles is directly physically coupled to a heating resistor, each heating resistor is directly physically coupled to a plurality of firing field effect transistors, and each transistor in each plurality of firing field effect transistors that is directly physically coupled to a common heating resistor shares a common address within the each primitive.

8. A method, comprising:

extracting, by a fluid ejection array controller of a fluid ejection device, a first bit from a virtual primitive control packet delivered over a data path from a remote source, wherein the fluid ejection device comprises a plurality of nozzles to eject fluid, the plurality of nozzles is arranged into a plurality of primitives, and the plurality of primitives is further arranged into a plurality of virtual primitives that each contains at least two primitives of the plurality of primitives;

identifying, by the fluid ejection array controller based on the first bit, for each virtual primitive of the plurality of virtual primitives, a first primitive of the at least two primitives that includes a nozzle that should be fired and a second primitive of the at least two primitive that includes a nozzle that should not be fired;

setting, by the fluid ejection array controller, a first bit value in a signal to be sent to the plurality of virtual primitives, the first bit value instructing the plurality of virtual primitives to not fire nozzles in the second primitive of the at least two primitive.

9. The method of claim 8, wherein the first bit is included in a header of the virtual primitive control packet.

10. The method of claim 8, wherein the first bit value is null value.

11. The method of claim 8, wherein within each primitive of the plurality of primitives, each nozzle of the plurality of nozzles is directly physically coupled to a heating resistor, each heating resistor is directly physically coupled to a plurality of firing field effect transistors, and each transistor in each plurality of firing field effect transistors that is directly physically coupled to a common heating resistor shares a common address within the each primitive.

12. The method of claim 8, wherein a second bit value in the signal is set by the remote source, the second bit value instructing the plurality of virtual primitives to fire nozzles in the first primitive of the at least two primitives.

13. The method of claim 8, wherein the remote source is a print engine controller of a printing system.

14. An apparatus, comprising:

an interface to a data path over which a virtual primitive control packet for controlling fluid ejection by a fluid ejection device travels; and a packet receiver to extract a first bit from the virtual primitive control packet and to populate bits of data in ejection control data with values that indicate that portions of the fluid ejection device should not eject fluid.

15. The apparatus of claim 14, wherein the virtual primitive control packet includes a second bit value set by a source of the virtual primitive control packet, the second bit indicating that other portions of the fluid ejection device should eject fluid.

16. The apparatus of claim 14, wherein the fluid ejection device is part of an inkjet printing device.

17. The apparatus of claim 16, wherein the fluid ejection array controller is included in a print engine of the inkjet printing device.

18. The apparatus of claim 17, wherein the data path connects the interface to a print engine controller of the inkjet printing device.

19. The apparatus of claim 14, wherein the first bit is contained within a header of the virtual primitive control packet.

20. The apparatus of claim 14, wherein the first bit is a null value.

* * * * *